US006052958A

United States Patent [19]

Miedema et al.

[11] Patent Number: 6,052,958

[45] Date of Patent: Apr. 25, 2000

[54] WALL PANEL SYSTEM

[75] Inventors: Wayne Miedema, Holland; Robert Fox, Allendale; Richard Klamforth, Norton Shores, all of Mich.

[73] Assignee: Haworth, Inc., Holland, Mich.

[21] Appl. No.: 09/144,141

[22] Filed: Aug. 31, 1998

Related U.S. Application Data

[63] Continuation of application No. 08/660,504, Jun. 7, 1996, Pat. No. 5,806,258.

[51] Int. Cl.[7] ..... E04B 1/38; E04B 2/74

[52] U.S. Cl. ..... 52/284; 52/239; 52/281; 52/286; 52/270; 52/582.1; 52/590.1; 52/591.1; 52/592.1

[58] Field of Search ..... 52/239, 578, 582.1, 52/589.1–591.1, 590.2, 282.2, 270, 271, 275, 284, 592, 281, 286

[56] References Cited

U.S. PATENT DOCUMENTS

| | | | |
|---|---|---|---|
| 3,378,977 | 4/1968 | Vervloet . | |
| 3,585,768 | 6/1971 | Klein . | |
| 4,021,973 | 5/1977 | Hegg et al. . | |
| 4,126,978 | 11/1978 | Heller | 52/461 |
| 4,625,483 | 12/1986 | Zackey et al. | 52/239 |
| 4,631,881 | 12/1986 | Charman . | |
| 4,807,412 | 2/1989 | Frederikson | 52/591.1 X |
| 4,852,317 | 8/1989 | Schiavello et al. . | |
| 4,905,428 | 3/1990 | Sykes . | |
| 4,967,531 | 11/1990 | Giles et al. . | |
| 4,968,171 | 11/1990 | Shell | 52/285 X |
| 5,363,616 | 11/1994 | Hernnandez | 52/282.2 X |
| 5,491,943 | 2/1996 | Vondrejs et al. . | |

FOREIGN PATENT DOCUMENTS

| | | |
|---|---|---|
| 2246801 | 2/1992 | United Kingdom . |
| 2247257 | 2/1992 | United Kingdom . |
| 2250759 | 6/1992 | United Kingdom . |

*Primary Examiner*—Robert Canfield
*Attorney, Agent, or Firm*—Flynn, Thiel, Boutell & Tanis, P.C.

[57] ABSTRACT

A space-dividing wall panel system having a plurality of upright wall panels serially connected one with the other by an intermediate upright support post. The height of each wall panel is adjusted by modular panel extension assemblies which are mounted on base panels supported by lower support posts and include extension posts connected to the lower support posts so as to be arranged coaxial therewith. Spaced apart pairs of the extension posts are connectable to a cross rail at upper ends thereof which defines a downwardly extending generally U-shaped extension frame. A serially adjacent pair of extension frames shares a common extension post which is connected to both of the cross rails thereof, where the base panel and the extension panel assembly disposed thereon respectively define base and beltline raceways for workstation cabling. Additional extension posts can be inserted into the upper ends of extension posts already positioned so as to vertically extend the height of the wall panel. Removable covers are provided so as to overlie the outward faces of the base panel and the extension panels which panel covers are spaced outwardly from the outer faces of the base panel and extension frame so as to define passages therebetween. The passages permit horizontal cabling along the base raceway and the beltline raceway between adjacent wall panels while further permitting vertical routing of cabling between the base and beltline raceways within each panel.

20 Claims, 16 Drawing Sheets

WALL PANEL SYSTEM

This is a continuation of Ser. No. 08/660,504, filed Jun. 7, 1996 now U.S. Pat. No. 5,806,258.

FIELD OF THE INVENTION

This invention relates to a space-dividing wall panel system formed from upright serially-connected panels joined together by intermediate support posts and, more specifically, to a wall panel system employing both base panels supported by support post sections and one or more extension panel assemblies extending upwardly therefrom.

BACKGROUND OF THE INVENTION

Commercial buildings typically include large open office areas which are divided into smaller work spaces or workstations by any of a number of panel systems that have been developed therefor. These panel arrangements typically employ upright space-dividing wall panels which serially connect together through two-panel straight or angled connections, or through suitable three or four-panel connections, to subdivide the office area into a plurality of smaller workstations of desired size and configuration. Such panels are typically less than floor-to-ceiling height, and cooperate with other furniture components to define an equipped workstation. These components may include worksurfaces, file cabinets, shelf units and the like which mount directly on and are supported by the wall panels, and may also include free-standing furniture components such as tables, chairs and file cabinets.

In the known arrangements of panel systems, the individual panel assemblies have a variety of configurations. For example, in some arrangements, the individual panels are themselves supported directly in load-bearing relationship with a floor by support feet or glides. In other arrangements, serially-adjacent panel assemblies are interconnected through intermediate upright support posts or poles which bear the weight of the panels and in turn are maintained in load-bearing engagement with the floor. The present invention is an improved panel arrangement of the latter-mentioned post-type having intermediate upright support posts.

More specifically with respect to known post-type panel arrangements, the intermediate post comprises an upright support tube, often of cylindrical configuration, which tube engages cooperating parts on the adjacent panels to structurally connect and support the panels thereon.

In one post-type panel arrangement disclosed in U.S. Pat. No. 5 134 826, some panels may extend from floor to a height substantially above beltline height to define a fixed-height space-dividing wall and other panels may include a shorter panel section having one or more fixed rectangular panels vertically stacked thereon which panels are connected at their opposite ends to the upright support posts. This arrangement, however, requires a variety of pre-constructed rectangular panels to vary the height of the wall. Additionally, this system does not readily accommodate cabling at base and/or beltline heights.

In another arrangement disclosed in EP 0 050 241 A1, a wall is constructed from a plurality of spaced apart uprights having upper and lower horizontal members which have their opposite ends connected between the uprights to define a rectangular frame. Each mutually adjacent pair of panels share an intermediate one of the uprights. Such a wall panel arrangement, however, does not allow for ready modification of the height of the wall panel to accommodate the varying needs of each workstation.

In view thereof, it is an object of the invention to provide a wall panel system having a vertically adjustable modular height which is adjusted by the addition or removal of extension panel assemblies on to or off of a lower or base wall panel supported on a floor. It is another object that the modular height be readily adjustable while minimizing the number of component parts which thereby allows for ready assembly and disassembly of the panel extensions. It is a further object that the wall panel system accommodate a variety of workstation components and equipment such as shelves, desks and windows therethrough.

It is also an object that electrical and/or communication cabling be readily accommodated and accessible in a base raceway or a beltline raceway whereby the necessary cabling is routable both vertically within the base panel between the base and beltline raceways, and horizontally through horizontally adjacent raceways of serially adjacent panels. It is still a further object that the base raceway be defined by the base panel and the beltline raceway be addable to the base panel by providing an extension panel disposed at beltline height.

The present invention relates to a post-type space-dividing wall panel system having a plurality of base panels serially connected one with the other so as to define a vertically enlarged wall supported on a floor. Preferably, the base panel is enclosed by outward facing planar surfaces and is approximately 32 inches high. Each serially adjacent pair of base panels is connected one with the other by an upright lower support post or pole which is positioned in load-bearing relationship with the floor and is disposed intermediate the opposing ends of serially adjacent base panels. Thus, each base panel is supported by a pair of spaced apart support posts. The base panels are connected to the intermediate support posts in two-panel straight or angled configurations to divide an office space into a plurality of workstations.

To allow for modular adjustment of the height of the wall panels, the lower support posts are hollow tubular members which open upwardly. Extension posts or poles are coaxially inserted within the upper end of the lower support post in a bayonet connection such that the extension posts extend upwardly therefrom. To define an extension panel assembly, a horizontal cross rail or member is connected between a spaced apart pair of the extension posts. The extension posts and cross member thereby define a downwardly opening U-shaped frame which seats within the upper ends of the spaced pair of lower support posts supporting the base panel.

To further increase the height of the wall panel, each of the extension posts is a tubular member which opens upwardly therefrom so as to receive a generally identical arrangement of extension posts and a cross rail, i.e. a U-shaped extension frame which are seated within the open upper ends and extend upwardly from the lower extension panel. In this post-type arrangement, each cross rail of a serially adjacent pair of extension panel assemblies is connected to or shares a common extension post. Preferably, the extension posts have different modular lengths, for example, of 10 or 16 inches, to vary the height of a particular extension panel assembly.

To accommodate power distribution assemblies within the wall panel, each extension panel assembly includes a open interior defined by the extension posts, the cross member and the upper edge of the base panel which open interior generally defines a horizontal raceway at approximately beltline height. Additionally, the base panel is connected to the lower support post so as to be spaced upwardly from the floor and defines a generally horizontal base raceway between the floor and the bottom edge of the base panel.

To accommodate cabling, mounting means are provided for mounting lower and upper panel covers in overlying engagement with the outside faces of the base panel and each extension panel assembly. In particular, the mounting means comprise clips which connect the upper and lower edges of the lower and upper cover panels respectively to the base panel and the extension panel so that the panel covers are spaced outwardly away from the opposing surfaces of the base panel and the extension panel. The base panel space between the interior surface of the cover panels and the opposing exterior surface of the base panel defines a vertical passageway where cabling is layable within this space so as to extend between the base and beltline raceways. Similarly, the space between the interior surface of the upper cover panel and the exterior surfaces of the extension frame permits the passage of cabling horizontally therethrough so that cabling is extendable from the open interior of the extension panel first through the space formed between the extension post and the upper panel cover and then into a serially adjacent wall panel similarly formed with a space between the extension post and the cover panel.

Other objects and purposes of the invention, and variations thereof, will be apparent upon reading the following specification and inspecting the accompanying drawings.

Figure 1:
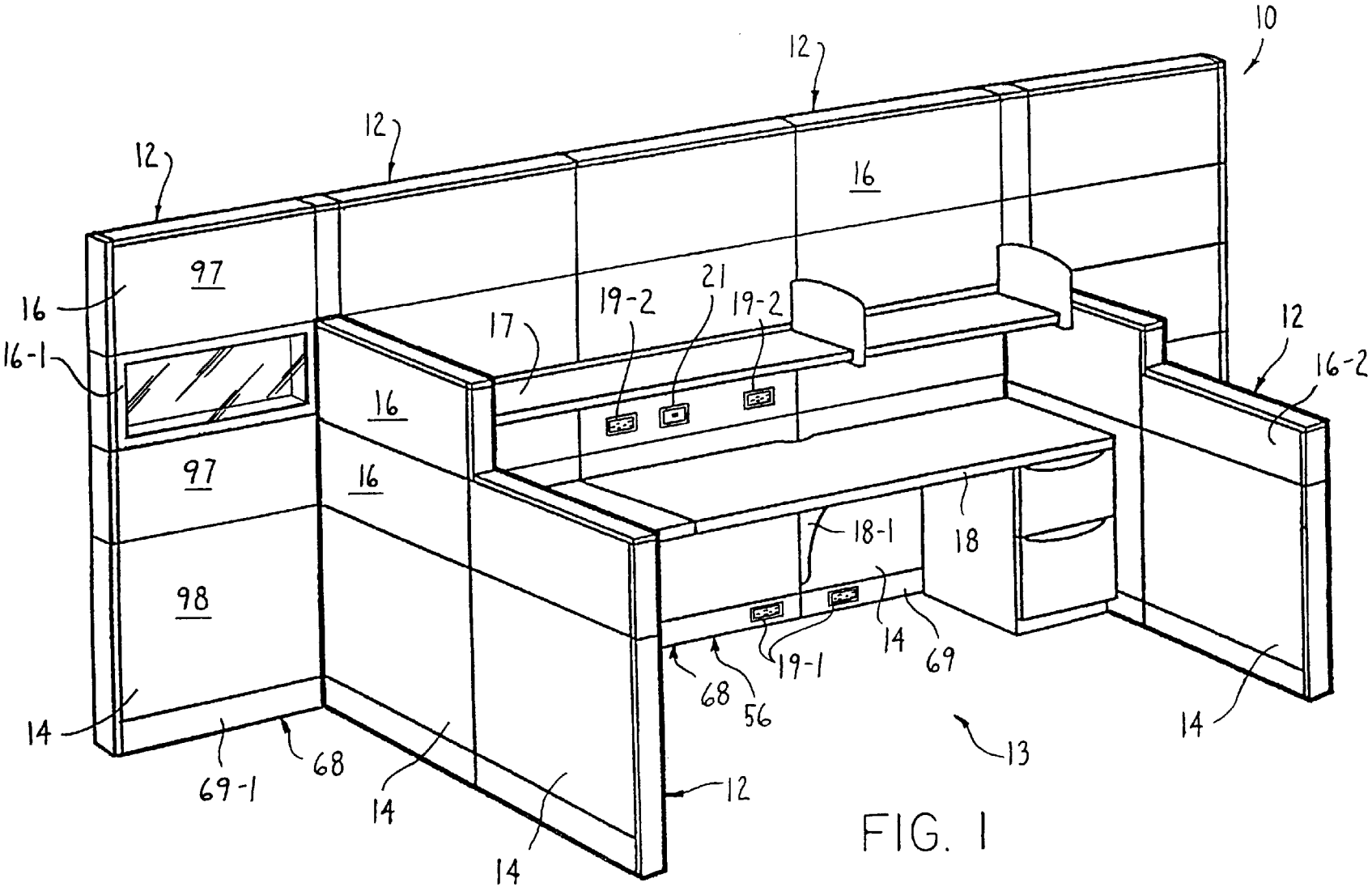
FIG. 1 is a perspective view illustrating a wall panel system of the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
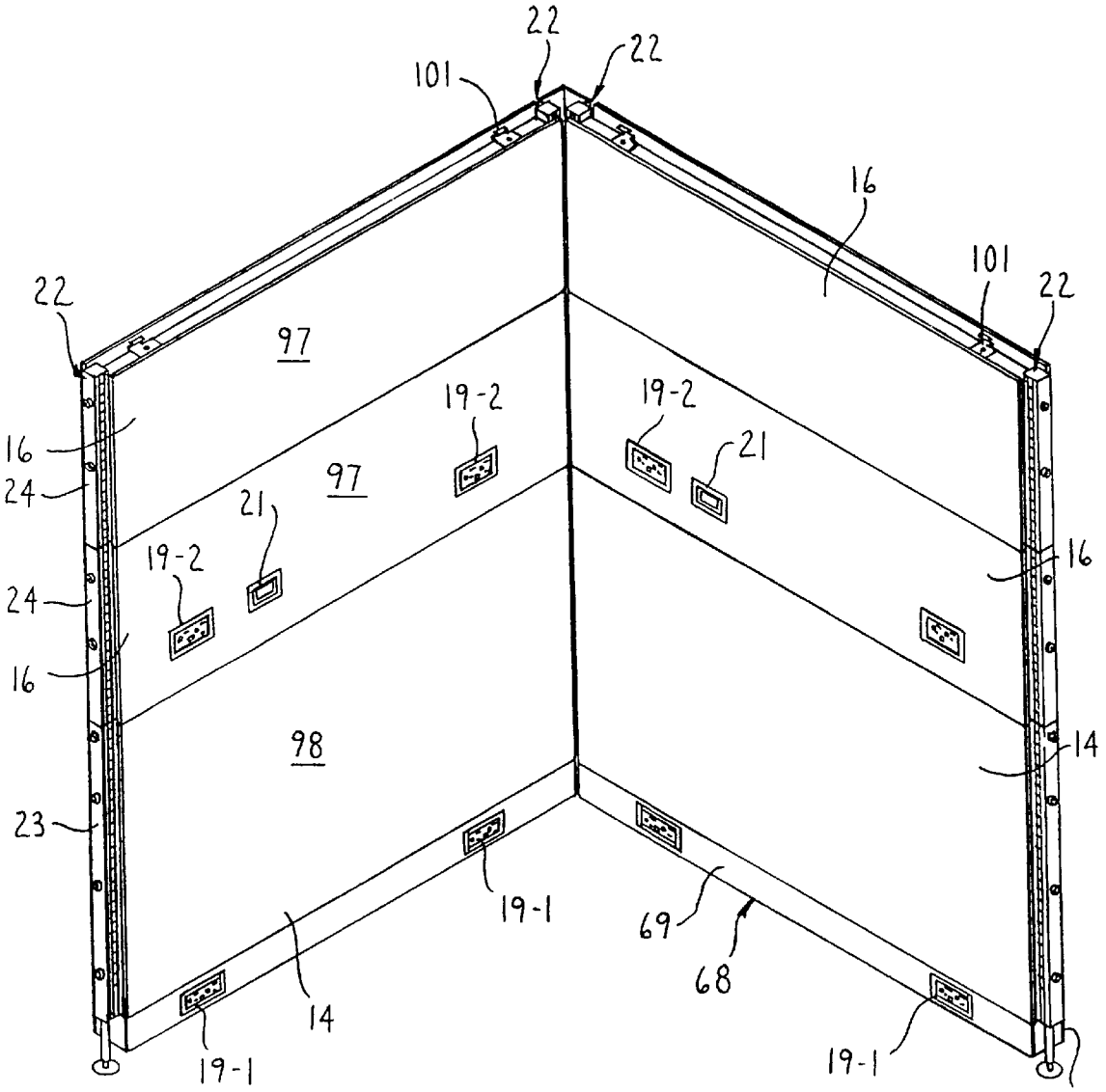
FIG. 2 is a perspective view illustrating base panel assemblies and panel extension assemblies of the wall panel system in a right angle corner configuration.

Referring to FIGS. 1 and 2, the invention generally relates to a wall panel system 10 which includes a selected number of upstanding wall panel assemblies 12 serially connected, for example, in two-panel straight or angled, or three- or four-panel corner configurations so as to subdivide an office area into separate workstations 13. Each wall panel assembly 12 at least includes a base panel assembly 14 supported on a floor and typically includes one or more modular extension panel assemblies 16 positioned vertically one above the other in a vertical plane.

Generally, each workstation 13 is defined by a selected arrangement of the base panel assemblies 14 which are serially connected one with the other to form at least a lower section of a vertically extending wall. Besides selectively subdividing the office area by the placement of the base panel assemblies 14, the wall panel system 10 thereafter permits modular adjustment of the wall height by selective placement of one or more extension panel assemblies 16 vertically on each base panel assembly 14. In the illustrated arrangement, one, two or three extension panels 16 are vertically positioned or "stacked" although additional extension panels are mountable one atop the other which height may extend closely proximate a ceiling if desired.

Additionally, the wall panels 12 support office components such as a shelf unit 17, a work surface 18, or other conventional furniture components while additional free-standing components (not illustrated) such as chairs, shelf units and filing cabinets can be positioned within the workstation 12. To accommodate additional workstation equipment (not illustrated) such as telephones, computers, facsimile machines and the like, the wall panels 12 also selectively include electrical receptacles 19-1 at a base raceway height, additional electrical receptacles 19-2 at a beltline height disposed above the worksurface 18, and further communication receptacles 21 for connection to modems or telephones. The specific arrangement and components of the wall panel system 10 are described in further detail hereinafter.

More particularly, the wall panel system 10 is a post-type system having a plurality of the wall panel assemblies 12

Figure 5:
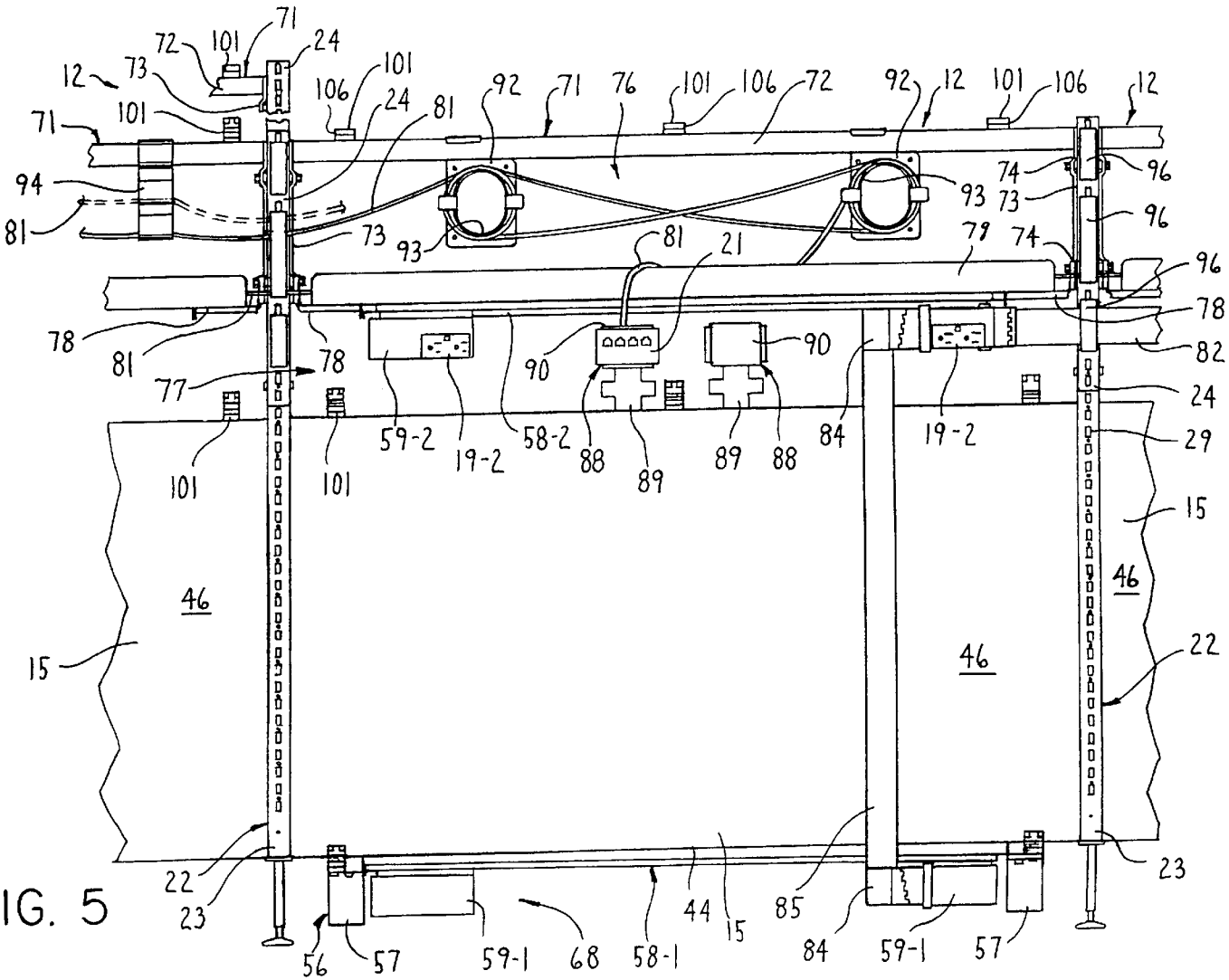
FIG. 5 is a partial front elevational view illustrating serially adjacent wall panel assemblies.

(FIGS. 2 and 5) serially connected one with the other where each serially adjacent pair of the wall panel assemblies 12 are connected together by a vertical upright or post assembly 22 which is positioned in load-bearing relationship with the floor and is disposed intermediate the adjacent ends of the serially adjacent wall panels 12. Thus, each wall panel assembly 12 extends laterally and is supported at its opposite ends by two spaced apart uprights 22 (FIG. 3) with an intermediate one of the uprights 22 being connected between a pair of the wall panels 12 (FIG. 5).

As briefly discussed above, the wall panel assembly at least includes the base panel assembly 14 and may also include a selected number of extension panel assemblies 16. In view thereof, each upright 22 (FIGS. 3 and 4) includes at least a lower support post 23 in load-bearing contact with the floor for connection to a base panel 15 of the base panel assembly 14, and optionally includes one or more extension panel posts 24 which removably connect to and extend vertically from said lower support post 23.

Each lower support post 23 (FIGS. 6, 8 and 9) is vertically elongate and has a disc-like support foot 26 for contact with the floor. The foot 26 is in threaded engagement with an extension rod 27 which is of conventional construction for leveling the wall panels 12. The upper end of the extension rod 27 fixedly connects to a lower end of a square tubular section which substantially defines the overall vertical length of the lower support post 23. The tubular section is formed of two identical U-shaped channel sections 28 nested or mated together (FIG. 8) and then fixedly joined by welding. The upper end of the support post 23 thereby opens upwardly from a hollow interior thereof.

Figure 8:
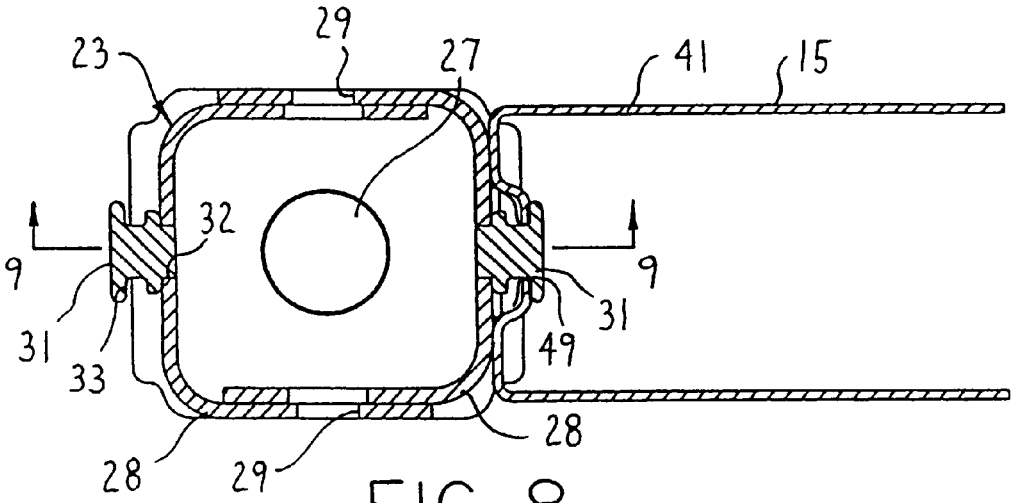
FIG. 8 is a partial top plan view in cross-section as viewed in the direction of arrows 8—8 of FIG. 3 illustrating a connection between a base panel and a lower support post.

To permit connection of furniture components to the uprights 22 on opposite outward facing sides of each wall panel 12, each lower support post 23 includes a plurality of rectangular apertures 29 which are formed on opposite outward facing sides of the support post 23 and in particular, are vertically spaced along the longitudinal length thereof. More particularly, each aperture 29 is defined by corresponding openings formed through the channel sections 28 which are aligned one with the other when the channel sections 28 are nested together (FIG. 8). The apertures 29 accommodate hook-like projections (not illustrated) on furniture component support brackets, for example, bracket 18-1 in FIG. 1. This spaced arrangement of apertures 29 and hook-like projections (not illustrated) is a conventional mounting arrangement used in wall panel systems and thus, a more detailed description is unnecessary.

To effect connection of the base panels 15 to the lower support post 23, the support post 23 also includes a plurality, and preferably three mounting pins 31 on opposite sides thereof which are vertically spaced apart and project laterally therefrom. Each pin 31 is seated within a corresponding bore 32 in one of the channel sections 28 and then "staked" or deformed therein for tight-fitting engagement therebetween. Each pin 31 also includes an annular mounting rim 33.

Figure 6:
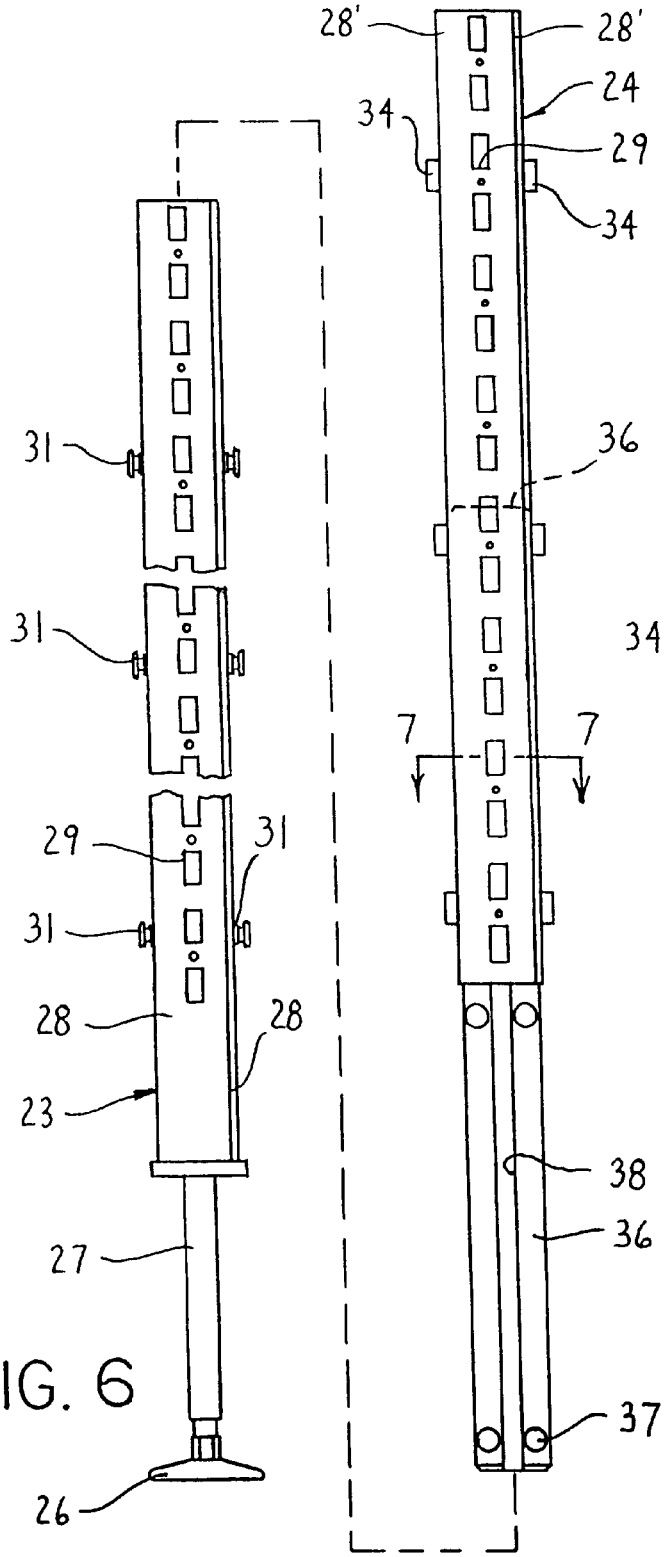
FIG. 6 is an exploded front elevational view illustrating a post assembly.
Figure 7:
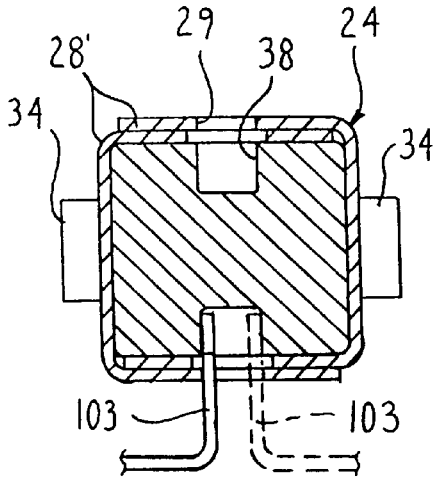
FIG. 7 is a top plan view in cross-section of the extension panel post as viewed in the direction of arrows 7—7 of FIG. 6.
Figure 14:
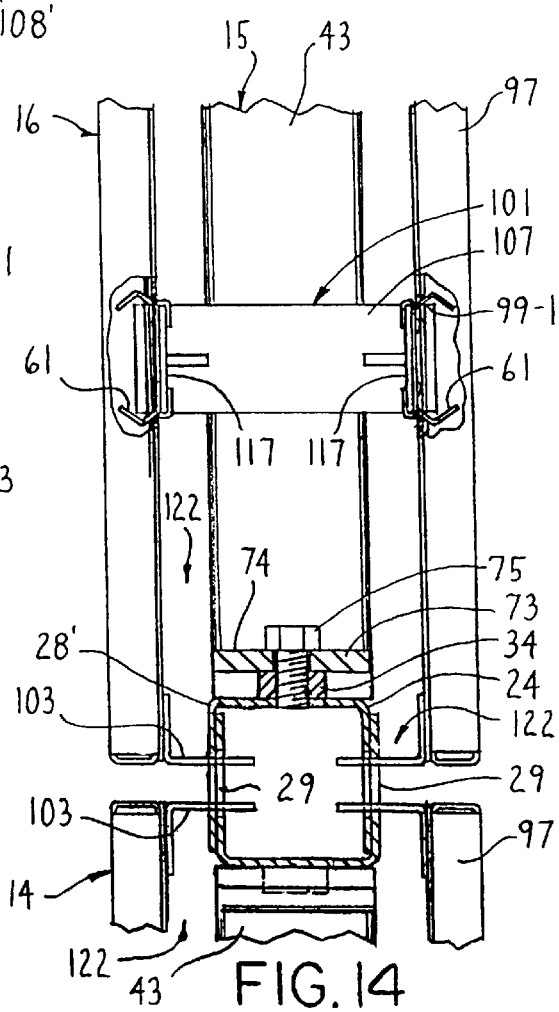
FIG. 14 is a partial top plan view in partial cross-section illustrating serially adjacent pairs of upper panel covers.

To allow for modular adjustment of the height of the wall panel assemblies 12, the open upper end of the support post 23 receives one extension post 16 coaxially inserted therein in a bayonet-like connection such that the extension post 16 extends upwardly therefrom. The upright 22 therefore may include at least one extension post 24 which is formed, like the support post 23, by a nested pair of channel sections 28' (FIGS. 6, 7 and 14). Preferably, the channel sections 28' have modular lengths of 10 or 16 inches. The channel sections 28' also includes apertures 29 for the connection of furniture components as described above. Each panel extension post 24 further includes a plurality and preferably, three laterally-projecting threaded hex-head lugs or nuts 34 on opposite sides of the extension post 24 which are vertically spaced therealong. Each lug 34 is mechanically fastened to the surface of the extension post 24 and includes a threaded bore therethrough.

To removably connect the extension post 24 and the support post 23 together, an elongate bayonet-like connector 36 is fixed within the lower end of the extension post 24 and projects downwardly therefrom. The lower end of the connector 36 is adapted to be slidably received within the open upper end of the lower support post 23 to provide the bayonet connection, and includes plastic spacers 37 on the lower end thereof to limit play. Additionally, so as to not block the apertures 29, the connector 36 also includes elongate channels 38 along the longitudinal length thereof which are formed on the opposite outward facing connector sides in alignment with the apertures 29 (FIG. 7). Preferably, the connector 36 is formed of two elongate metal plates (not illustrated) and a reduced width spacer (not illustrated) sandwiched therebetween to define the channels 38. Additionally, since the extension posts 24 are open at the upper ends thereof, the connectors 36 of additional extension posts 24 can be inserted therein to further extend the height of the upright 22.

The base panel 15 (FIGS. 3 and 4) which connects to the upright 22 is generally rectangular and extends vertically to approximately beltline height which typically is located just above worksurface height at approximately 32 inches. The base panel 15 has a frame generally formed from two elongate vertical rails 41 and 42 which define laterally spaced apart ends of the base panel 15, and two elongate horizontal rails 43 and 44 which define upper and lower base panel edges that extend laterally between the opposite panel ends. The rails 41–44 are joined with planar metal skins or surfaces 46 which define opposite outward facing side surfaces thereof. To dampen sound and increase strength, a honeycomb material 47 of known construction is provided therein and a plurality of holes 48 (diagrammatically illustrated in FIG. 4) are formed through the skin surfaces 46.

Figure 3:
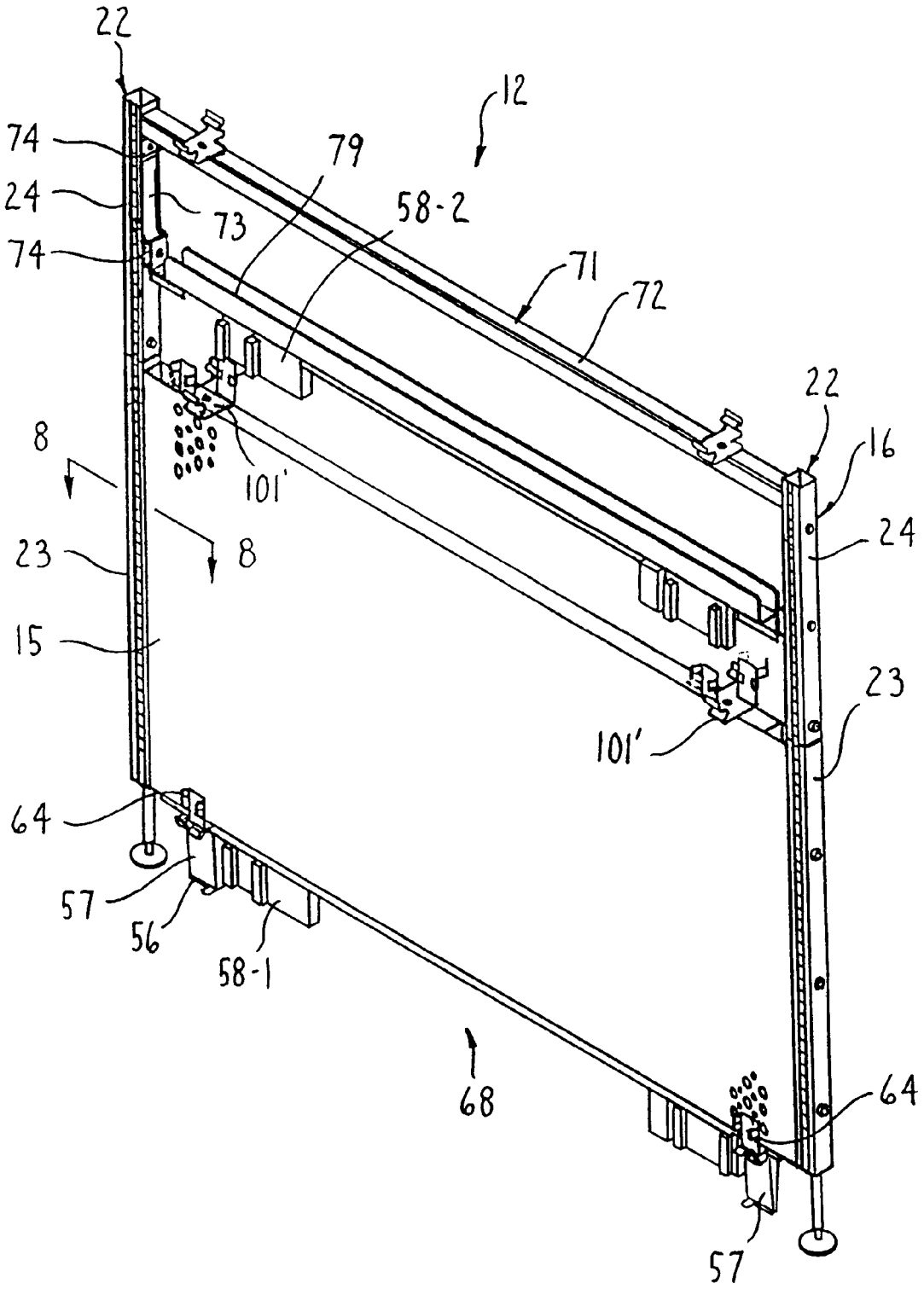
FIG. 3 is a perspective view illustrating one wall panel assembly without panel covers.
Figure 9:
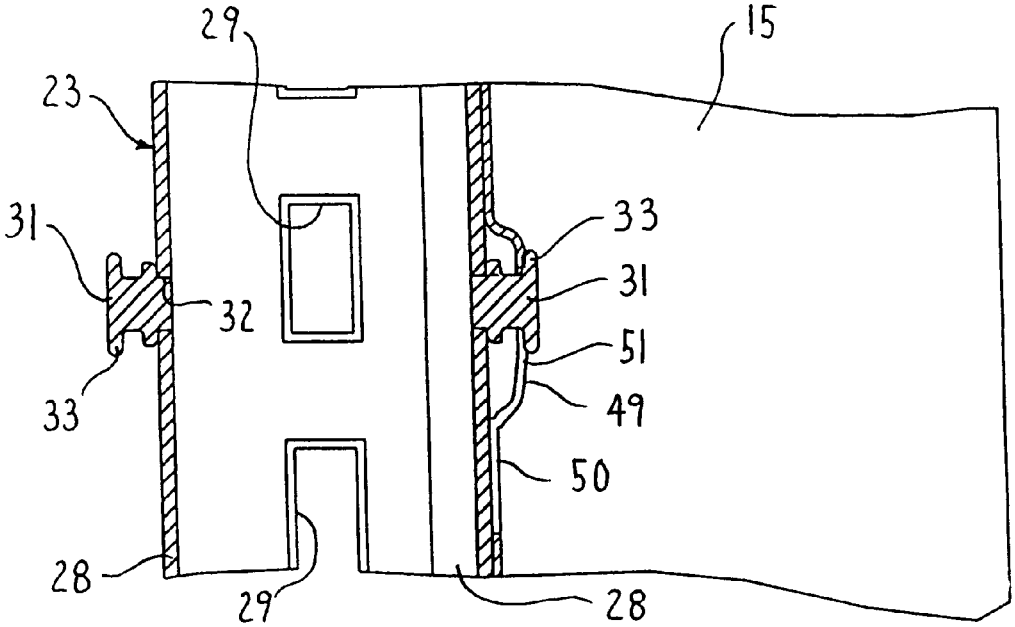
FIG. 9 is a partial front elevational view in cross-section as viewed in the direction of arrows 9—9 of FIG. 8 illustrating the connection between the base panel and the lower support post.
Figure 10:
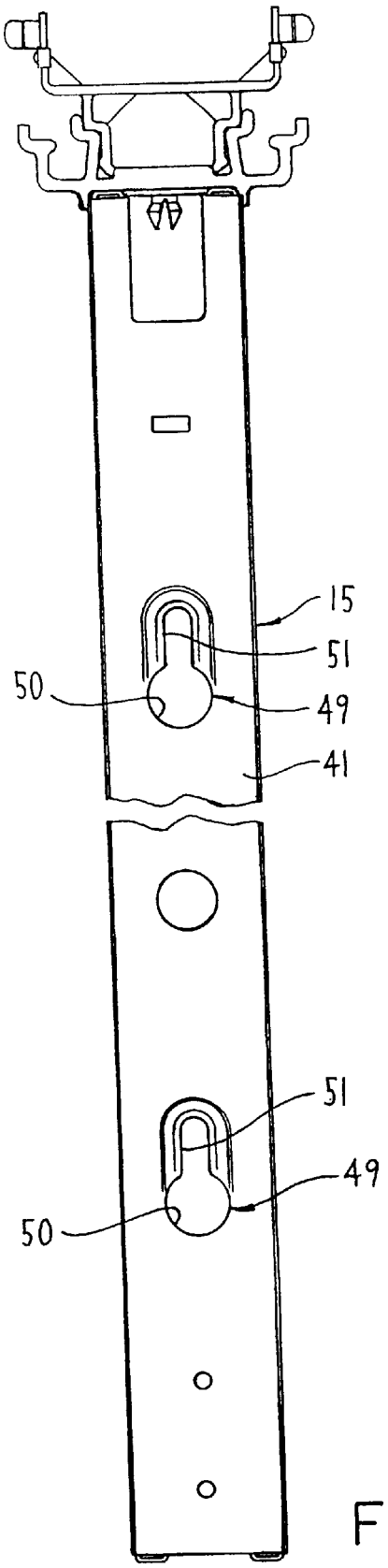
FIG. 10 is a broken side elevational view of a base panel having a mounting clip assembly mounted thereon.

Referring to FIGS. 8–10, each end rail 41 and 42 includes three keyhole slots 49 spaced vertically therealong which are located so as to line up with the support post pins 31. Each keyhole slot 49 includes a circular portion 50 which receives the rim 33 of the pin 31 therethrough and a reduced width slot portion 51 which is slid onto the pin 31 to effect engagement of the base panel 15 to the lower support post 23 as seen in FIGS. 3, 8 and 9. Thus, connection occurs by moving the base panel 15 and support post 23 together and then lowering the base panel 14 until annular rim 33 of the pin 31 engages the back side of slot portion 51.

To lock the base panel 15 in place, each end rail 41 and 42 also includes locking means, such as a spring clip (not illustrated). When the base panel 15 is seated on the pins 31, the mounting means preferably releasably engages the support post 23 so as to prevent inadvertent upward movement of the base panel 15 relative thereto.

Additionally, when connected to the support posts 23, the base panel 15 is spaced vertically above the floor so as to define a horizontally elongate space therebetween which accommodates a raceway assembly 56 (FIGS. 1, 3 and 5). The raceway assembly 56 generally includes a pair of mounting brackets 57 near the opposite base panel ends, and a power distribution assembly 58-1 (hereinafter referred to as "PDA") which is suspended from the lower base panel rail 44. The PDA 58-1 includes power blocks 59 at the opposite ends thereof and is adapted to carry electrical power therethrough. The power blocks 59 each are connectable to the receptacles 19-1. The PDA 58-1 (or 58-2 discussed below) is a commercially available product sold by the assignee for the PREMISE wall panel system and thus, a more detailed discussion thereof is not believed necessary.

Figure 11:
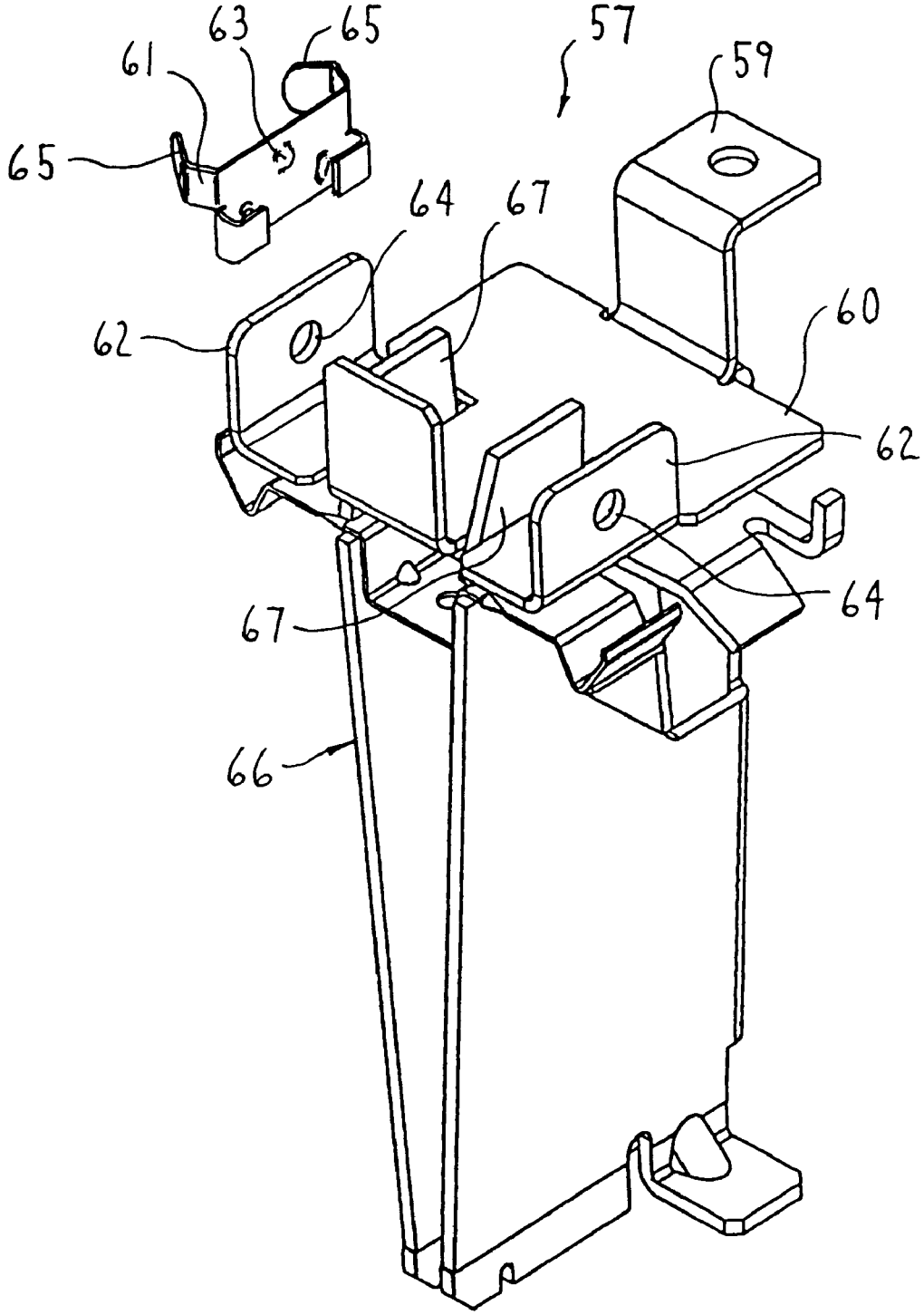
FIG. 11 is a perspective view illustrating a base raceway mounting bracket.

As seen in FIG. 11, each mounting bracket 57 is suspended from the bottom rail 44 by a fastener engaged with a fastener flange 59 which extends from an upper bracket 60. The upper bracket 60 also includes a pair of spring clips 61 (one of which is illustrated) slidably received over a respective vertical flange 62, and secured thereto by a detent 63 which engages a flange aperture 64. Resilient arms 65 of the spring clip are described in more detail herein with respect to the coverings for the wall panel assemblies 12.

Each mounting bracket 57 also includes a support assembly 66 which includes upwardly extending weld flanges 67 which are welded together with the upper bracket 60. The lower portion of the support assembly 66 serves to support a bottom raceway tray (not illustrated) which defines a bottom of a base raceway 68, and also removably connects raceway covers 69 (FIG. 2) on the opposite sides of the base panel 15. The support assembly 66 is substantially similar to a panel leg for the commercially available PREMISE wall panel system sold by the assignee but has been modified to connect to the upper bracket 61 as described above, and thus, a more detailed description of the support assembly 66 is not believed necessary. In particular, the structure and connection of the bottom raceway tray (not illustrated) and the raceway covers 69 to a support bracket such as the support assembly 66 is known.

As seen in FIGS. 1, 2 and 5, the base raceways 68 of serially adjacent base panels 15 generally open laterally one into the other to define a continuous horizontal raceway through the length of the wall panel system 10. Using conventional power distribution techniques developed for the PREMISE PDA's 58-1 sold by the assignee or using other available power distribution products, power can be distributed at base height where needed, for example, by connecting a receptacle 19-1 to a selected power block 59 and then enclosing the base raceways 68 by appropriate raceway covers 67 formed with receptacle ports therethrough. Where power is not needed, fully enclosed raceway covers 67-1 (FIG. 1) are provided.

Once the base panels 15 are connected to support posts 23 such that a workstation 13 is defined thereby, it may then be desirable to increase the height of the wall panel system 10 by the addition of extension panel assemblies 16.

Figure 4:
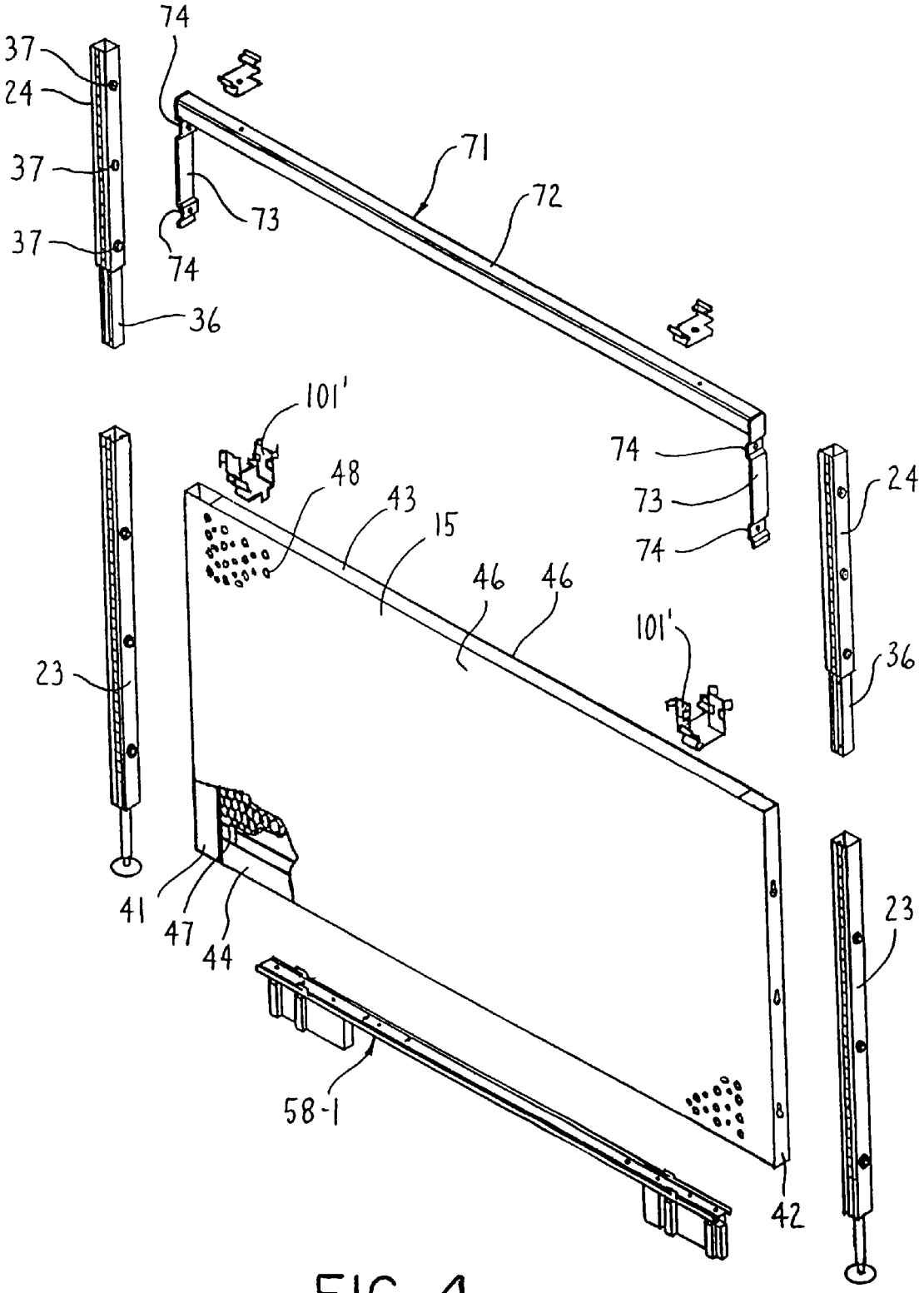
FIG. 4 is an exploded perspective view illustrating the wall panel assembly of FIG. 3.

Each panel extension assembly 16 is formed preferably by first inserting a pair of spaced apart extension posts 24 into the upper open ends of a spaced apart pair of serially adjacent lower support posts 23 as seen in FIGS. 3 and 4. The panel extension assembly 16 further includes a horizontal cross rail or member 71 which extends laterally between the pair of extension posts 24 and is fastened to the lugs 37 thereof.

More particularly, the cross rail 71 includes a rigid tubular section 72 and a pair of downwardly extending connector plates 73 joined to opposite ends thereof. When positioned between the extension posts 24, each connector plate 73 generally lies in a facing relation against opposing interior surfaces of the extension posts 24 and further includes two stepped sections 74 which seat over the two uppermost lugs 34. Each stepped section 74 (FIG. 14) includes a horizontal aperture through which a threaded fastener 75 such as a bolt is inserted into threaded engagement with the lug 34 such that the cross rail 71 is fixedly secured between the extension posts 24. Thus, the cross rail 71 and the extension posts 24 define a downwardly opening U-shaped frame which is connected to the base panel 15 through the bayonet connection with the lower support post 23.

Additional extension panel assemblies 16 can be added vertically (FIGS. 1 and 5) in the same manner and in particular, additional U-shaped frames can be formed vertically one atop the other. Where two extension panel assemblies 16 are formed serially adjacent to each other, the cross rails 71 are each connected to an intermediate one of the extension posts 24 which is disposed therebetween (FIG. 5).

Once assembled, an open interior 76 is defined by the extension posts 24, the cross rail 71 and the upper base panel rail 43 which open interior 76 generally defines a beltline raceway 77. While location of the raceway 77 at beltline is desirable, it is also possible to provide electrical or communication cables in any or all of the open interiors 76 of the extension panels 16 located between the base panel 14 and a ceiling.

To mount an additional PDA 58-2 within the beltline raceway 77, a pair of right angled brackets 78 are respectively mounted to the extension posts 24, and in particular, are secured to the lowermost lugs 34 by subsequent threading of the fastener 75 therethrough. Once connected, a horizontal leg of the mounting bracket 78 extends inwardly into the open interior 76 to support a respective end of a U-shaped elongate cable trough or channel 79 which provides not only an interior support member for the PDA 58-2 but also permits laying in of cabling, such as communication cabling 81. Preferably, the troughs 79 of serially adjacent extension panel assemblies 16 are horizontally aligned to define a continuous trough-like passage whereby cabling 81 can be laid therein and routed over the faces of the intermediate extension post 24 (FIG. 5).

For routing of electrical power through the wall panel system 10, the PDA 58-2 is suspended from the trough 79 which PDA 58-2 includes laterally spaced apart power blocks 59-2 that are electrically connected one with the other. Once the PDA 58-2 is secured in place, receptacles 19-2 are selectively connected to the power blocks 59-2 on either side of the PDA 58-2. In order to electrically connect the PDAs 58-2 of serially adjacent extension panels 16, a horizontal flex connector 82 is connected to the respective power blocks 59-2 by plugs 83 at the opposite ends thereof. Preferably, the flex connector 82 extends between serially adjacent panel assemblies 12 by laying over the intermediate extension post 24. To further permit electrical connection of the PDAs 58-1 and 58-2 respectively located in the base raceway 66 and the beltline raceway 77, plugs 84 at the opposite ends of a vertical connector cable 85 are respectively connected to power blocks 59-1 and 59-2 which connector cable 85 is routed over the outward facing base panel surfaces 46.

Figure 15:
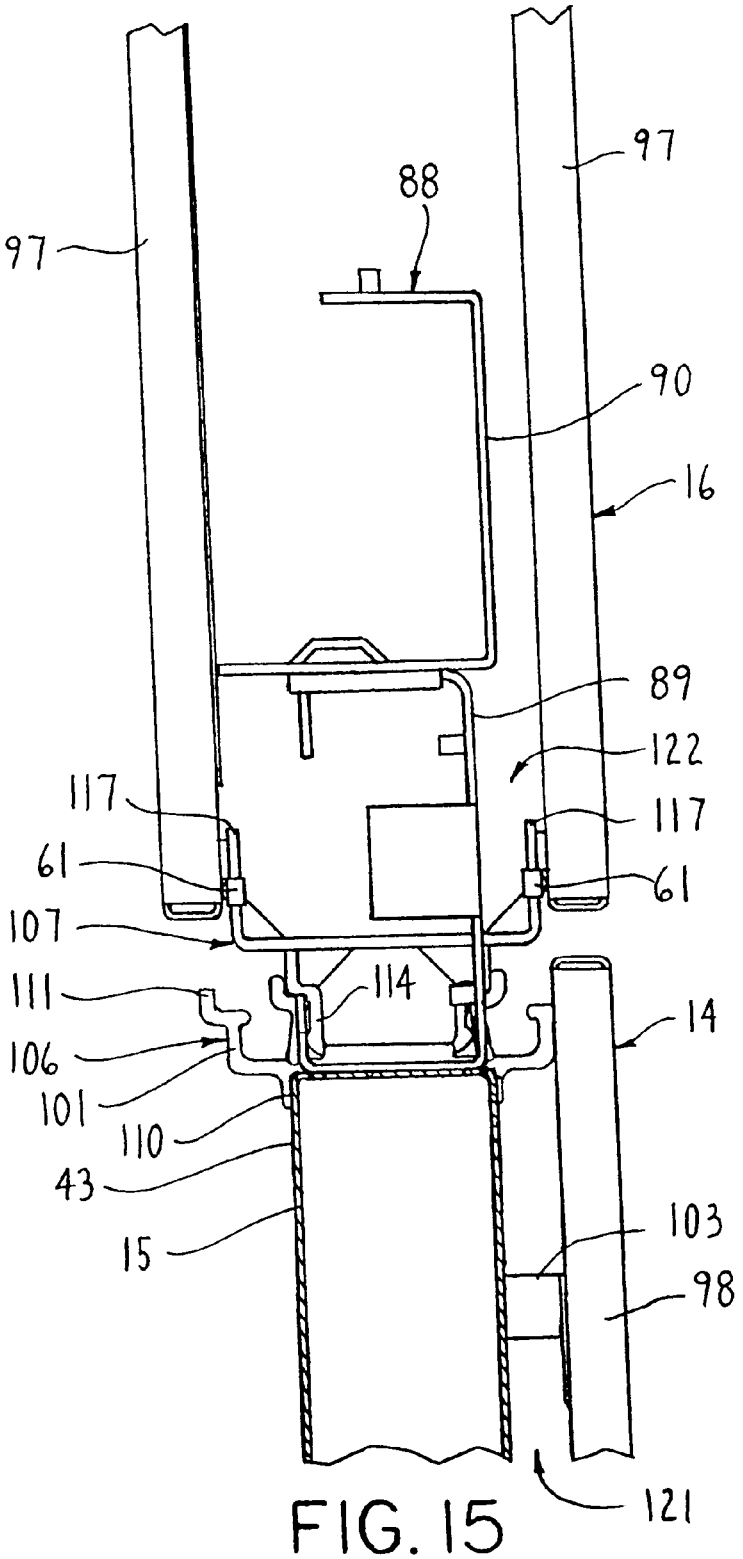
FIG. 15 is a partial side view in partial cross-section illustrating a communication receptacle housing between the upper wall panels.

As illustrated, the beltline raceway 77 also includes the communication receptacles 21 which are connected to the upper base panel rail 43. Referring to FIGS. 5 and 15, the communication receptacle 21 is mountable within and supported by a mounting bracket assembly 88 which comprises a support bracket 89 fastened to the upper rail 43 and a receptacle housing 90 that generally defines a box-like interior which opens sidewardly from one side of the extension panel 16. An additional mounting bracket assembly 88 is disposed laterally adjacent thereto which second mounting bracket assembly 88 preferably faces toward an opposite side of the extension panel 16 to provide access to communication circuits from both sides of the wall panels 12. The communication receptacles 21 are electrically connected to the communication cabling 81 which preferably is laid in the trough 79 and then dropped down over a sidewall thereof.

To further assist in the management of cables and in particular, communication cabling 81 which typically is formed of continuous lengths of conventional electrical cables, a pair of cable reels 92 (FIG. 5), for example, may be mounted to the cross rail 71 which cable reels 92 include a cylindrical spool 93 about which excess cabling 81 can be looped, for example in a FIG. 8 configuration. Additionally, where communication receptacles 21 are not provided in a extension panel assembly 16, it may be desirable to pass the cabling 81 therethrough either in the trough 79 or by providing cable support brackets or "cable trees" 94. The cable support brackets 94 are suspended from a corresponding cross rail 71 and include sidewardly projecting legs on which the cabling 81 is supported. Support trees of similar configuration are generally known for supporting electrical cables in various environments.

To protect the cabling 81 or the horizontal flex connectors 82 which pass over the exterior faces of the extension posts 24, generally U-shaped bridge-like cover brackets 96 are provided, the legs of which hook into appropriate apertures 29 in the uprights 22 so as to permit the passage of the cabling 81 or flex connectors 82 therethrough while at the same time providing a barrier which prevents furniture mounting brackets, for example, 18-1 (FIG. 1) from inadvertently contacting the cabling 81 or flex connectors 82 which may cause damage thereto.

Once the interior framework and components of the wall panel system 10 are assembled, upper and lower cover pads or panels 97 and 98 (FIGS. 1, 13 and 15) are respectively connected to the extension panel assemblies 16 and the base panel 15 so as to define an outer finished surface of the wall panel assemblies 12. Each lower cover panel 98 is rectangular and is dimensioned so as to overlie the base panel 15 as well as a portion of the lower support post 23. Similarly, the upper cover panel 97 is also rectangular and overlies the open interior 76 of the extension panel assembly 16 while at the same time permitting access to the electrical and communication receptacles 19-2 and 21 therethrough. The upper and lower cover panels 97 and 98 are formed with a variety of configurations depending upon the requirements of each workstation 13 and in particular, may be formed as painted, fabric, veneer, acoustical or tackboard-type panels. Instead of panels 97, it is also possible to provide glass or open panels 16-1 as seen in FIG. 1. While the specific configuration of each panel may vary depending upon the function being served thereby as well as whether any receptacles 19-1, 19-2 or 21 are being accessed therethrough, each cover panel 97 or 98 generally includes the following common features.

Figure 13:
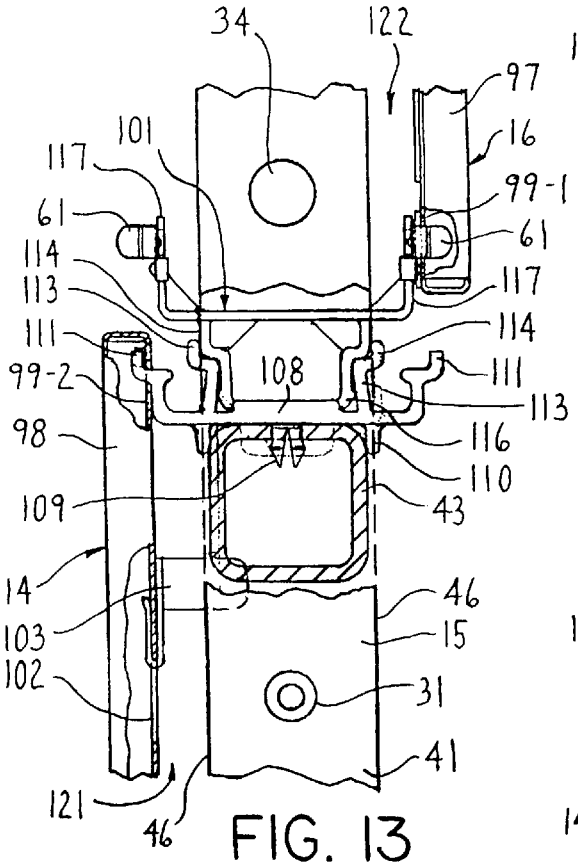
FIG. 13 is a side elevational view in partial cross-section illustrating upper and lower panels connected to the mounting clip assembly.
Figure 17:
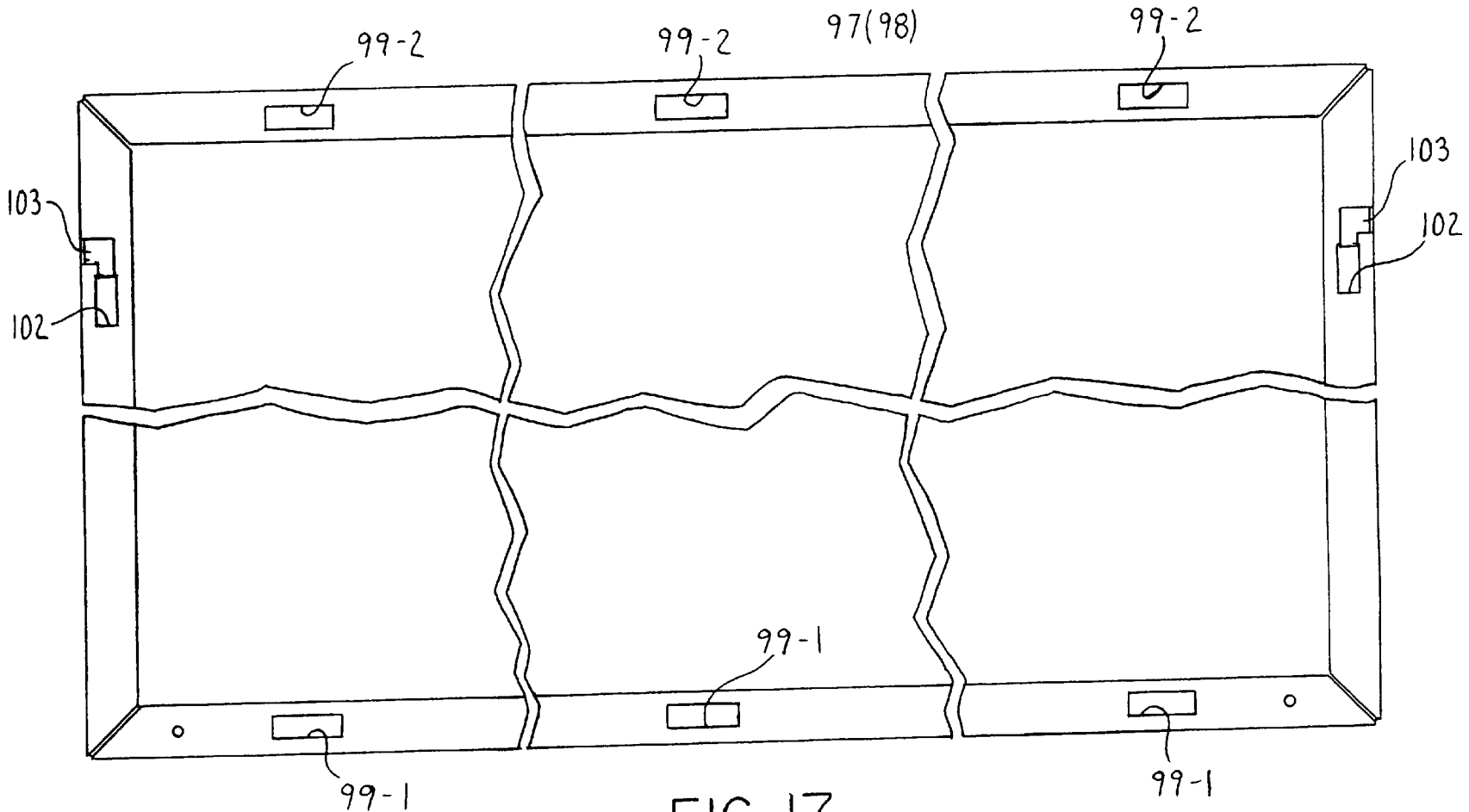
FIG. 17 is a broken rear view of a representative panel cover.

As seen in FIGS. 13 and 17, each lower cover panel 98 is substantially rectangular and dimensioned so as to extend vertically between the bottom rail 44 and a height proximate to but somewhat above the upper base panel rail 43 to accommodate cover mounting means which will be discussed below. The lower cover panel 98 also extends laterally between the lower support posts 23 and in particular, is dimensioned so as to extend partially across each support post 23 such that a serially adjacent pair of the lower cover panels 98 are laterally spaced so as to expose the apertures 29 of the lower support post 23 and accommodate furniture component support brackets therebetween. FIG. 14 generally illustrates a serially adjacent pair of upper cover panels 97 which are laterally spaced one from the other which laterally spaced arrangement is substantially identical to the spaced arrangement of the lower cover panels 98.

The upper cover panel 97 similarly is dimensioned like the lower cover panel 98 such that it extends vertically from the top edge of the lower cover panel 98 and upwardly to a height closely proximate but spaced above the cross rail 71. To effect mounting of the upper and lower cover panels 97 and 98 to the wall panel assembly 12, the frames of each wall panel 97 or 98 (FIG. 17) includes a plurality and preferably three laterally spaced bottom openings 99-1 and top openings 99-2 which are aligned vertically one with the other. The openings 99-1 and 99-2 are connectable to cover panel mounting clips 101 which will be discussed in more detail hereinafter.

When securing the cover panels 97 and 98, it is desirable that each cover panel be vertically located and thus, the backside of each cover panel 97 and 98 includes a pair of openings 102 each disposed proximate the opposite cover panel ends which allow the connection of a locator clip 103 thereto. Each locator clip 103 resiliently clips over an upper edge of the opening 102 as illustrated generally in FIGS. 13 and 14 and includes a locator leg which projects away from the back panel face and seats within one of the apertures 29.

More particularly with respect to the mounting clips 101, a plurality of the mounting clips 101 are generally located on each cross rail 71 and on the upper base panel rail 43 and, in combination with the spring clips 61 of the raceway mounting brackets 57, serve to connect the upper and lower edges of the cover panels 97 and 98. More specifically, to provide space to accommodate the cabling 81 and the horizontal and vertical PDA connectors 82 and 85 which all are routed over the exterior surfaces of the extension posts 24 or the base panel 15, the mounting clip assemblies 101 serve to connect the cover panels 97 and 98 in an outwardly spaced relation from the exterior outward facing surfaces of the uprights 22, the cross rail 71 and the base panel 15.

The mounting clip assembly 101 on the cross rail 71 supports an upper edge of one of the upper cover panels 97 while the mounting clip assembly 101 on the upper rail 43 serves to secure the opposite bottom edge thereof. The mounting clip assembly 101 on the upper rail 43 also serves the additional function of vertically supporting the top edge of a lower cover panel 98 for the base panel 15 while the spring clip 64 on the raceway mounting brackets 57 (FIG. 11) connects the opposite lower edge of this panel in place. Since the mounting clip assembly 101 on the cross rail 71 may also have to support an upwardly adjacent panel where a second extension panel assembly 16 is vertically stacked thereon, this mounting clip assembly 101 preferably serves the dual function of not only vertically supporting a downwardly hanging panel 97 but also securing a bottom end of a further panel 97 upwardly therefrom.

Figure 12:
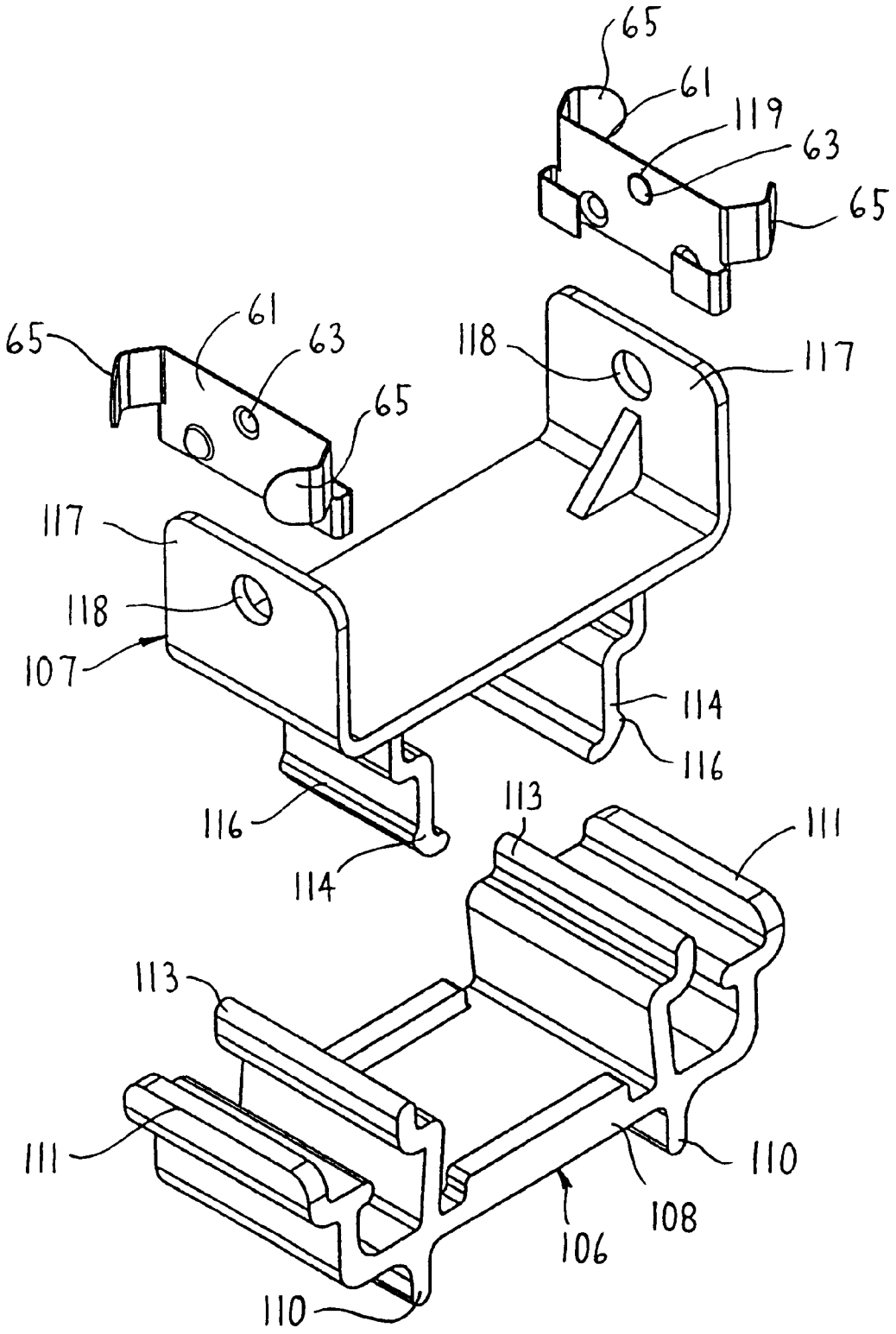
FIG. 12 is an exploded perspective view illustrating the mounting clip assembly.

Accordingly, a preferred mounting clip arrangement is illustrated in FIGS. 12 and 13 which mounting clip arrangement includes a first mounting bracket 106 which connects to the cross rail 71 or the upper base rail 43 for supporting a panel top and a second mounting bracket 107 which is removably connectable to the first mounting bracket 106 by a snap-fit engagement for supporting a panel bottom such that the specific construction of each mounting clip assembly 101 may be varied. Preferably, the clips are formed of a suitable material such as metal or plastic.

Referring to FIGS. 12-14, an exemplary one of the mounting clip assemblies 101 which utilize both the first and second mounting brackets 106 and 107 (FIGS. 12–14) is illustrated in position on the upper base rail 43. The first mounting bracket 106 includes a bottom plate 108 which rests upon a top surface of the upper base rail 43 (or a cross member 71) and is fixedly connected thereto by a downwardly projecting snap-fit connector 109 which resiliently snaps into fixed engagement with an aperture in the upper base rail 43 (or the cross member 71). The bottom plate 108 also includes downwardly directed spaced apart flanges 110 which seat on opposite sides of the upper base rail 43 for stability and further includes sidewardly extending and upwardly directed hook-like mounting flanges 111 which extend a predetermined distance outwardly from the upper base rail 43 so as to hook into and space the lower cover panel 98 outwardly away from the base panel 15. In particular, the mounting flanges 111 are hooked into the openings 99-2 so that the cover panel 98 generally is suspended in downwardly hanging engagement therewith. This first mounting bracket 106 also is included on the cross rail 71 (FIG. 5) for suspending the upper cover panel 97 therefrom. To connect the first and second mounting brackets 106 and 107 one with the other, the first mounting bracket 106 further includes a pair of sidewardly spaced and upwardly extending engagement flanges 112 which angle slightly one towards the other to define a tapered seat 113 therebetween. The tapered seat 113 also may snap-fittingly engage a top cap or upper trim.

The second mounting bracket 107 includes cooperating downwardly depending engagement flanges 114 which are formed with a bulbous section 116 proximate a lower terminal end thereof which engagement flanges 114 and in particular, the bulbous portions 116 thereof are snap fittingly pressed into the seat 113 into a tight-fitting engagement one with the other. While readily connectable, the second mounting bracket 107 also is removable without the necessity of removing the first mounting bracket 106 from the wall panel 12.

The second mounting bracket 107 further includes upwardly extending connector plates 117 which include an aperture 118 and are adapted to slidably receive spring clips 61. Each spring clip 61 is slidably fitted over the connector plates 117 until a detent 63 thereof is snapped into the apertures 118 such that the spring clip 61 is fixedly secured in position with the resilient arms 65 projecting outwardly therefrom. These resilient arms 65 are dimensioned sufficiently greater than the width of the lower openings 19-1 such that the resilient arms are snapped into the openings 19-1 so as to releasably engage the lower edges of either of the respective upper and lower cover panels 97 and 98. Similarly, the bottom of the cover panels 98 are engaged by the spring clips 61 mounted on the raceway mounting brackets 57.

When the cover panels 97 and 98 are secured in position, a lower space or gap 121 is formed between an inward facing surface of the lower cover panel 98 and the outward facing base panel surfaces 46 so that, for example, the vertical connector cable 85 is able to be routed in this space 121 between the base and beltline raceway 66 and 67. Similarly, upper spaces 122 are defined between the inward facing back surface of the upper panel 97 and the outward facing exterior surfaces of the extension posts 24 which upper spaces 122 generally are defined along the vertical length of each respective extension post 24. These upper spaces 122, therefore, permit passage of the cabling 81 as well as the horizontal flex connectors 82 horizontally across the extension post 24 and along the entire length of the wall panel system 10.

Figure 16:
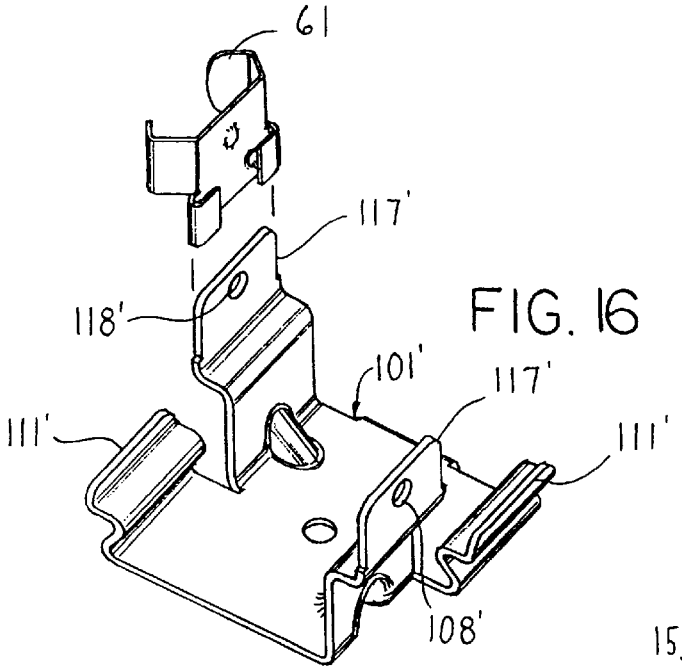
FIG. 16 is an exploded perspective view of an alternative embodiment of the mounting clips.

In an alternative configuration for the mounting clip assembly 101 designated in FIG. 16 as 101', the mounting clip assembly 101' may be formed out of a single sheet of metal material and include engagement flanges 111 for the tops of cover panels and additional connector plates 117' which receive the spring clip 61 thereon. The spring clips 61 and engagement flanges 111' are laterally offset. Examples of these alternative clips 101' are generally illustrated in use in FIGS. 2 and 3.

Figure 18:
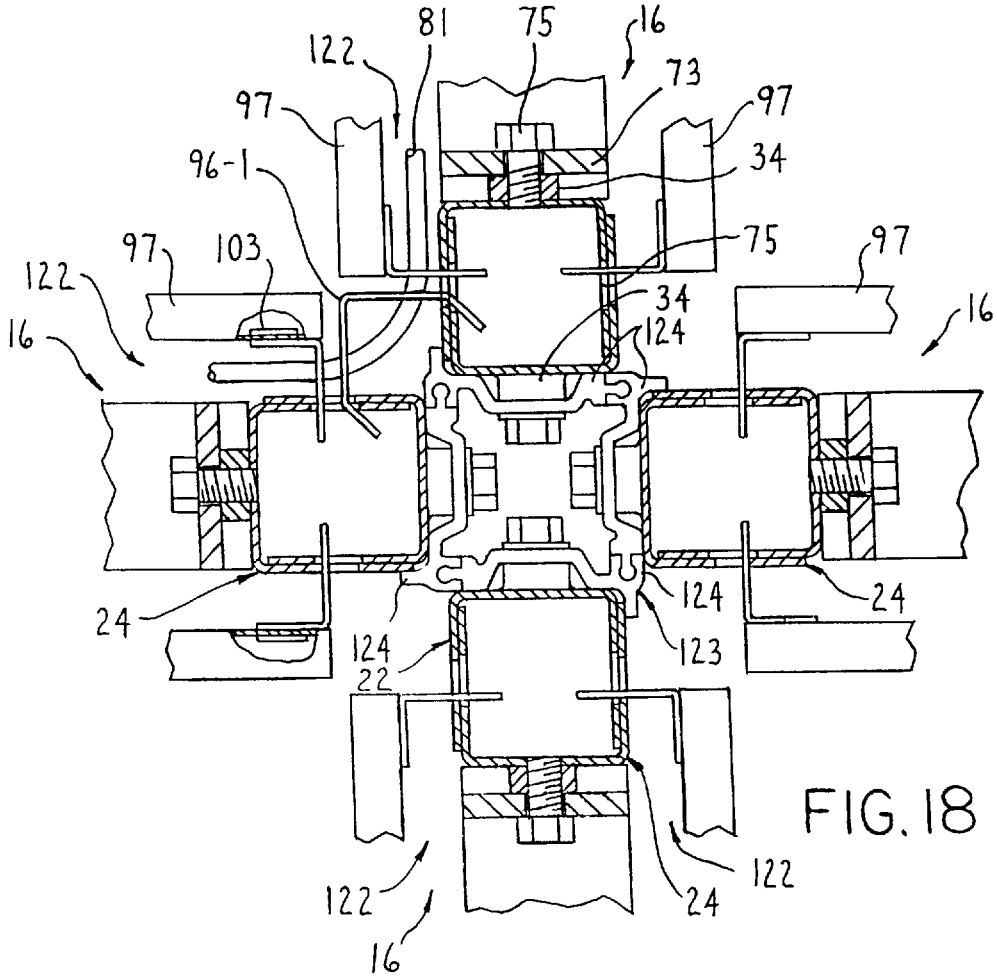
FIG. 18 is a top view in partial cross-section illustrating a four-way panel connection.
Figure 19:
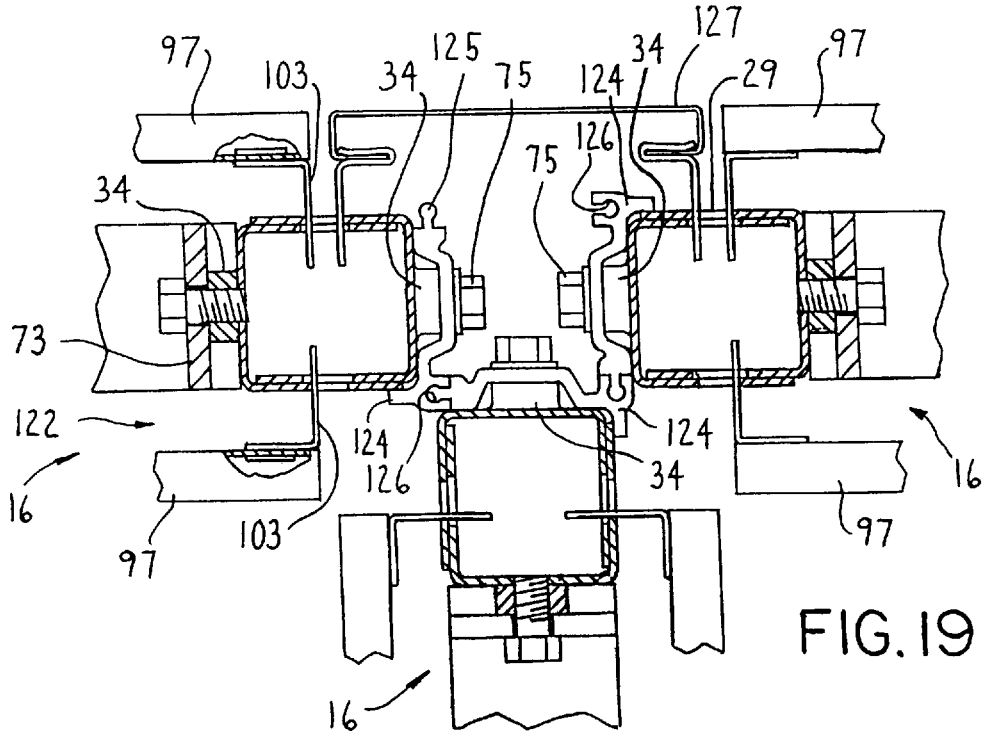
FIG. 19 is a top plan view in partial cross-section illustrating a three-way panel connection.
Figure 20:
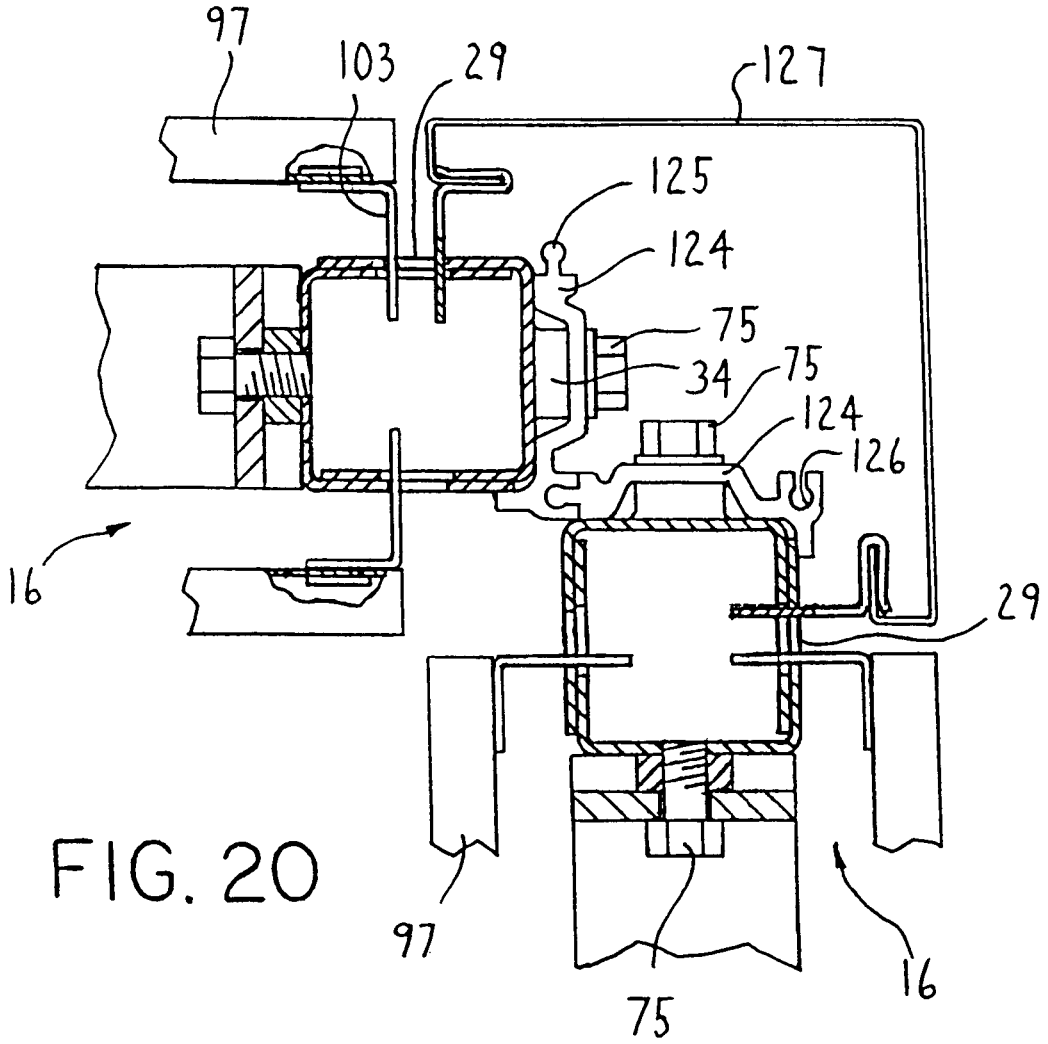
FIG. 20 is a top plan view in partial cross-section illustrating the two-way corner connection of FIG. 2.

Referring to FIGS. 18–20, construction of the wall panel system 10 typically will require the construction of two-panel corners or three- and four-panel connections (generally illustrated in FIGS. 1 and 2). Since each wall panel assembly 12 is supported by the upright assemblies 22 at the ends thereof, two or more upright assemblies 22 will be disposed closely adjacent one another and require connection therebetween to form the two-, three- and four-panel connections. Thus, an intermediate connector assembly 123 is provided to connect the uprights 22 together. As seen in FIGS. 18–20, connection of panel extension assemblies 16 uses the threaded lugs 34 thereof which are removably connected to a plurality of interlocking plates 124 of the connector assembly 123. Each interlocking plate 124 is generally rectangular and includes a circular bead 125 along one vertical edge and a corresponding slot 126 at an opposite vertical edge which slot 126 opens vertically therefrom so as to slidably receive the semi-circular bead 125 of an adjacent interlocking plate 124. When two interlocking plates 124 are connected together as generally seen in FIG. 20, a right angle connector is formed. Up to four interlocking plates 124 (FIG. 18) are connectable together which forms a four-sided tube. The interlocking plates 124 are separable so as to permit their mounting independently to the respective uprights 22 which interlocking plates 124 are then connected together by downward sliding of the panel extension posts 24 into position. Once two or more wall panel assemblies 12 are connected together, a suitable trim cover plate 127 is engaged with apertures 29 so as to enclose open sides of the connection. In the four-panel connection of FIG. 18, a further bridge-like cover plate 96-1 for cabling is illustrated which is positioned between two adjacent uprights 22 so as to define a corner cover for the cabling 81.

Figure 21:
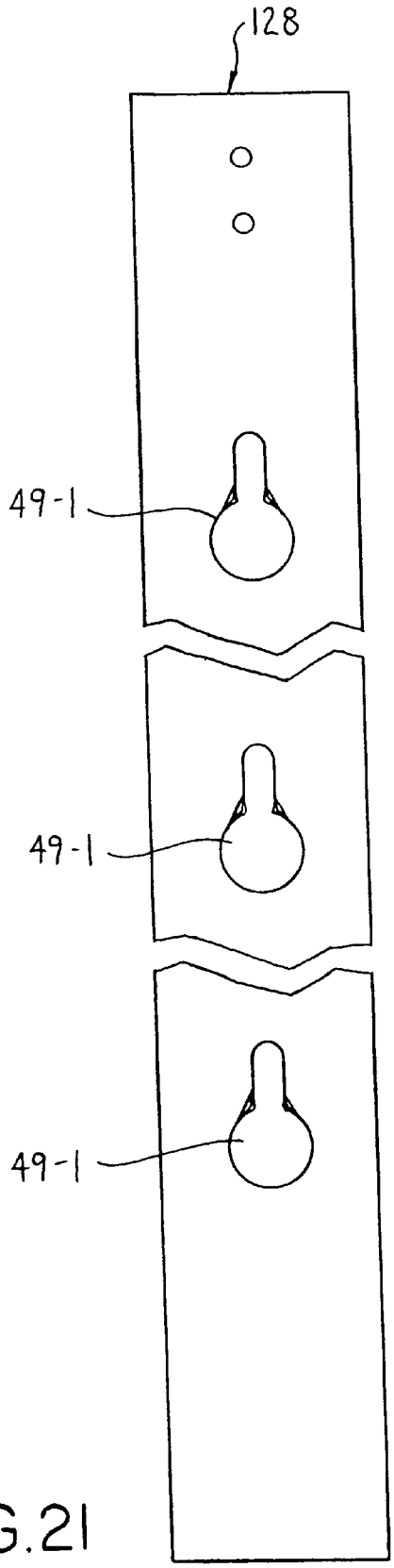
FIG. 21 is a broken left side elevational view of a base panel connector tube for two-, three- and four-way panel connections.

In FIG. 21, a connector tube 128 of the connector assembly 123 is illustrated for connection of base panel assemblies 14 which connector tube 128 is a rectangular tubular member having three vertically spaced keyhole slots 49-1 on the four vertically elongate sides thereof. The keyhole slots 49-1 are adapted to mount to the pins 31 of the lower support posts 23 and thereby connect base panel assemblies 14 to any or all of the four connector tube sides.

In view of the foregoing, an office area can be subdivided into a selected configuration of workstations 13 by appropriate positioning and connection of base panels 14 to lower support posts 23. To vary the height thereof, additional extension panel assemblies 16 can be selectively stacked onto a base panel assembly 14 by connection of a suitable number of panel extension posts 24 onto the lower support post 23, and thereafter connecting a cross rail 71 therebetween. In view of the foregoing discussion, a wide variation in constructions of the wall panel system 10 can be achieved.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a wall panel arrangement comprising a plurality of space-dividing wall panels and a connector assembly which joins adjacent ends of said wall panels together to define a corner connection wherein said wall panels are oriented transversely relative to each other, comprising the improvement wherein said connector assembly comprises a plurality of connector plates wherein each of said wall panels have a corresponding one of said connector plates mounted thereto, said connector plates being joined together to define said corner connection between said wall panels, each of said connector plates including a vertically elongate bead which extends vertically and projects sidewardly from said connector plate in a first direction, and a vertically elongate channel having a shape corresponding to said vertical bead, said vertically elongate channel having an open side which opens sidewardly in a second direction oriented transverse to said first direction, said bead of one of said connector plates being slidably received in said channel of an adjacent one of said connector plates to join an adjacent pair of said wall panels together in said corner connection, said channel preventing removal of said bead sidewardly through said open side thereof such that said adjacent wall panels are joined together solely by said channel and said bead joined therewith.

2. The wall panel arrangement according to claim 1, wherein said channel has an open end which opens vertically to permit sliding of said bead vertically therein.

3. A wall panel arrangement according to claim 1, wherein each of said connector plates have said bead and said channel disposed on opposite vertical side edges thereof.

4. A wall panel arrangement according to claim 3, wherein said connector plates are removably connected to said wall panels corresponding thereto.

5. A wall panel arrangement according to claim 1, wherein said open side of said channel is smaller than said bead which is slidably received therein such that said channel prevents removal of said bead sidewardly through said open side.

6. A wall panel arrangement according to claim 1, wherein said wall panels are axially elongate, one of said bead and said channel projecting axially and the other of said bead and said channel projects sidewardly.

7. A wall panel arrangement according to claim 1, wherein four of said connector plates are joined together to define a rectangular tube which joins four of said wall panels together.

8. In a wall panel arrangement comprising a plurality of wall panels and a connector assembly for joining said wall panels together in a corner arrangement wherein said wall panels are oriented transversely relative to each other, said connector assembly comprising a plurality of connector plates which are removably connected to said wall panels respectively, comprising the improvement wherein said wall panels are axially elongate and each of said ccnnector plates includes a vertically elongate rib along one side thereof and a vertically elongate channel along another side thereof, said channel having a vertical open side and narrowing horizontally towards said open side, said rib widening horizontally to define an enlarged bead, said channel having an open end which opens vertically and permits sliding of said rib downwardly into said channel, said open side being narrower than said enlarged bead so as to prevent said rib from being slid horizontally out of said channel through said open side thereof, said rib of one of said wall panels being engaged with said channel of an adjacent one of said wall panels such that said adjacent wall panels are joined together solely by the engagement of said rib with said channel, said rib projecting in a direction oriented transverse to said open side such that said adjacent wall panels when joined together are oriented transverse relative to each other.

9. A wall panel arrangement according to claim 8, wherein each adjacent pair of said connector plates are oriented substantially at right angles relative to each other such that four of said connector plates when joined together define a rectangular tube.

10. A wall panel arrangement according to claim 8, wherein said wall panel includes a vertical upright on which said connector plate is supported and a vertically enlarged rectangular panel which is supported on said upright.

11. A wall panel arrangement according to claim 8, wherein said bead and said channel on each of said connector plates extends vertically along opposite side edges thereof.

12. A wall panel arrangement according to claim 11, wherein each of said connector plates is connected to said respective wall panel by removable fasteners.

13. A wall panel arrangement according to claim 8, wherein each of said channels only permits removal of said bead of an adjacent one of said connector plates vertically from said channel.

14. In a wall panel system comprising a plurality of space-dividing wall panels and a connector assembly which connects adjacent ends of said wall panels together, comprising the improvement wherein said connector assembly includes a plurality of interlocking connectors, each of said interlocking connectors including a vertically elongate slot and a vertically elongate rib wherein said slot on one of said interlocking connectors cooperates with and interlocks with said rib of an adjacent one of said interlocking connectors, said slot opening vertically to permit sliding of said cooperating rib vertically therein such that each adjacent pair of said interlocking connectors are interlocked together, said interlocking connectors being oriented transverse relative to each other and at least two of said wall panels being provided wherein each said wall panel is connected to a corresponding one of said interlocking connectors of said connector assembly.

15. The wall panel system according to claim 14, wherein an open space is formed between two of said interlocking connectors when interlocked together and said wall panel system further includes a vertically elongate trim cover which encloses said open space, opposite vertical side edges of said trim cover being connected to said wall panels which are connected to said two interlocking connectors.

16. The wall panel system according to claim 15, wherein least one of two of said interlocking connectors are joined together to define a generally L-shaped connector assembly, or three of said interlocking connectors are joined together to define a generally U-shaped connector assembly.

17. The wall panel system according to claim 15, wherein said wall panels include vertical rails at the ends thereof, each said vertical rail including a plurality of vertically spaced notches wherein each of said opposite sides of said trim cover is engagable with said notches of said vertical rails.

18. The wall panel system according to claim 14, wherein each of said wall panels includes a separable vertical end rail to which said corresponding interlocking connector is engaged, said interlocking connectors being joined together by movement of said vertical rail separate from said wall panel so as to slide said rib of said corresponding interlocking connector into engagement with said interlocking connector disposed adjacent thereto.

19. The wall panel system according to claim 18, wherein each of said wall panels includes a lower section having a lower rail at the end thereof, said wall panel system further including a connector tube which joins the lower rails of the wall panels together, said separable rails being removably engaged with and supported vertically above the lower rail.

20. The wall panel system according to claim 19, wherein the bottoms of the wall panels are connected together by the connector tube and the tops of the wall panels are connected together by the connector assembly.

* * * * *

UNITED STATES PATENT AND TRADEMARK OFFICE

CERTIFICATE OF CORRECTION

PATENT NO. : 6 052 958
DATED : April 25, 2000
INVENTOR(S) : Wayne MIEDEMA, et al.

It is certified that error appears in the above-indentified patent and that said Letters Patent is hereby corrected as shown below:

On the title page, item [75]; change "Richard KLAMFORTH" to ---Richard KLAMFOTH---.

Column 14, line 50; change "least one" to ---at least one---.

Signed and Sealed this

Tenth Day of April, 2001

*Attest:*

Nicholas P. Godici

NICHOLAS P. GODICI

*Attesting Officer*

*Acting Director of the United States Patent and Trademark Office*